US011072001B2

(12) United States Patent
Grönvall

(10) Patent No.: US 11,072,001 B2
(45) Date of Patent: Jul. 27, 2021

(54) VIBRATORY SCREENING APPARATUS

(71) Applicant: Metso Outotec Finland Oy, Tampere (FI)

(72) Inventor: Lars Grönvall, Trelleborg (SE)

(73) Assignee: Metso Outotec Finland Oy, Tampere (FI)

( * ) Notice: Subject to any disclaimer, the term of this patent is extended or adjusted under 35 U.S.C. 154(b) by 142 days.

(21) Appl. No.: 16/098,588

(22) PCT Filed: May 3, 2017

(86) PCT No.: PCT/EP2017/060521
§ 371 (c)(1),
(2) Date: Nov. 2, 2018

(87) PCT Pub. No.: WO2017/191181
PCT Pub. Date: Nov. 9, 2017

(65) Prior Publication Data

US 2019/0118225 A1 Apr. 25, 2019

(30) Foreign Application Priority Data

May 4, 2016 (EP) ..... 16168337

(51) Int. Cl.
*B07B 13/16* (2006.01)
*B07B 1/36* (2006.01)

(52) U.S. Cl.
CPC ..... *B07B 13/16* (2013.01); *B07B 1/36* (2013.01); *B07B 2201/02* (2013.01); *B07B 2201/04* (2013.01)

(58) Field of Classification Search
CPC ..... B07B 13/16; B07B 1/36; B07B 2201/02; B07B 2201/04
(Continued)

(56) References Cited

U.S. PATENT DOCUMENTS 2,683,533 A 7/1954 Frederick
3,087,617 A * 4/1963 Forsberg ..... B07B 1/284 209/319
(Continued)

FOREIGN PATENT DOCUMENTS

AU 2015101267 A4 10/2015
CN 202506590 U 10/2012
(Continued)

OTHER PUBLICATIONS

International Search Report and Written Opinion for International Patent Application No. PCT/EP2017/060521 dated Jul. 28, 2017.
(Continued)

*Primary Examiner* — Terrell H Matthews
(74) *Attorney, Agent, or Firm* — Andrus Intellectual Property Law, LLP

(57) ABSTRACT

A vibratory screening apparatus including a support and at least two screen decks arranged one over the other as an assembly. Each screen deck includes a screen frame, a screen and a chamber underlaying the screen surface, an outlet duct for oversized material and an outlet duct for undersized material in communication with the chamber. Mountings are configured for mounting the assembly of the screen decks to the support. A drive support with a motor assembly is configured for vibrating the assembly of screen decks. A feed unit is configured to feed the material to be screened to each screen deck. The feed unit is arranged on the support and configured to be moved between a feed position and a maintenance position. The assembly of the at least two screen decks is resiliently arranged on the support, while the feed unit is non-resiliently arranged on the support.

11 Claims, 5 Drawing Sheets

(58) Field of Classification Search
USPC ..... 209/243
See application file for complete search history.

(56) References Cited

U.S. PATENT DOCUMENTS

| | | | | |
|---|---|---|---|---|
| 3,826,367 | A | 7/1974 | Hubach | |
| 4,085,776 | A | 4/1978 | Derrick, Jr. | |
| 4,234,416 | A * | 11/1980 | Lower | B07B 13/16 209/247 |
| 4,322,288 | A | 3/1982 | Schmidt | |
| 4,495,065 | A | 1/1985 | Dereamer et al. | |
| 4,576,713 | A | 3/1986 | Melin | |
| 4,634,535 | A | 1/1987 | Lott | |
| 4,818,379 | A | 4/1989 | Eggerstedt | |
| 5,429,247 | A | 7/1995 | Lemay et al. | |
| 6,889,846 | B2 | 5/2005 | Olsen et al. | |
| 8,002,116 | B1 * | 8/2011 | Cato | B07B 1/46 209/319 |
| 8,453,844 | B2 | 6/2013 | Bailey | |
| 8,956,543 | B2 | 2/2015 | Carr et al. | |
| 9,205,459 | B2 | 12/2015 | Sauser | |
| 9,387,517 | B2 | 6/2016 | Carr et al. | |
| 9,718,008 | B2 | 8/2017 | Peresan et al. | |
| 2001/0052484 | A1 | 12/2001 | Fallon | |
| 2014/0263103 | A1 | 9/2014 | Peresan et al. | |
| 2017/0259302 | A1 * | 9/2017 | Erickson | B07B 1/42 |
| 2017/0291195 | A1 | 10/2017 | Peresan et al. | |
| 2017/0320098 | A1 * | 11/2017 | Knorr | B07B 11/06 |
| 2019/0118225 | A1 * | 4/2019 | Gronvall | B07B 13/16 |

FOREIGN PATENT DOCUMENTS

| | | | | |
|---|---|---|---|---|
| CN | 202877099 | U | 4/2013 | |
| CN | 204159547 | U | 2/2015 | |
| CN | 204620381 | U | 9/2015 | |
| DE | 3109319 | A1 | 9/1982 | |
| DE | 36 06 854 | A1 | 9/1987 | |
| FR | 3 003 776 | A1 | 10/2014 | |
| FR | 3003776 | A1 * | 10/2014 | B07B 1/46 |
| RU | 123350 | U1 | 12/2012 | |
| SU | 212046 | A1 | 2/1968 | |
| WO | 2012037243 | A2 | 3/2012 | |
| WO | 2013102699 | A1 | 7/2013 | |
| WO | 2014162070 | A1 | 10/2014 | |

OTHER PUBLICATIONS

International Preliminary Report on Patentability for International Patent Application No. PCT/EP2017/060521 dated Jul. 19, 2018.
Office Action issued in corresponding Chinese Application No. 2017800278019, dated Mar. 9, 2020.
U.S. Patent No. 852,050, issued Apr. 30, 1907, in the name of Malcolm L. Barbeau.
International Search Report for PCT/IBB2017/052561, dated Jul. 12, 2017.
Patent Search Report and Acceptance Decision for Russian Patent Application No. 201814079003, dated Jun. 16, 2020.
Examination Report for corresponding Indian Patent Application No. 201817042627 dated May 28, 2021.

* cited by examiner

VIBRATORY SCREENING APPARATUS

CROSS-REFERENCE TO RELATED APPLICATIONS

This application is the U.S. national stage application of International Application PCT/EP2017/060521, filed May 3, 2017, which international application was published on Nov. 9, 2017, as International Publication WO 2017/191181 in the English language. The International Application claims priority of European Patent Application 16168337.0, filed May 4, 2016.

FIELD OF THE INVENTION

The present invention relates to a vibratory screening apparatus comprising a plurality of piled screening decks.

BACKGROUND

Vibratory screening apparatuses for wet fine particle sizing and separation are widely used in mineral processing facilities, but also in drilling industry for removing drill cuts from drilling fluids.

In certain situations, floor space is at a premium and therefore it is advantageous to have screening decks piled on top of each other. Thus, a small foot print is of importance, as well as a compact arrangement of screening decks and easy maintenance thereof. At the same time, it is important to provide and maintain an even distribution of the wet fine particles onto the screens.

SUMMARY

An object of the invention is to provide a vibratory screening apparatus with easy maintenance.

Another object of the invention is to provide a vibratory screening apparatus with a small foot print.

Another object of the invention is to provide a compact arrangement of screening decks.

According to the invention, these and other objects are achieved, in full or at least in part, by a vibratory screening apparatus comprising a support; at least two screen decks arranged one over the other as an assembly, each screen deck including a screen frame, a screen and a chamber underlaying the screen surface, an outlet duct for oversized material and an outlet duct for undersized material that is in communication with the chamber; mountings configured for mounting the assembly of the at least two screen decks to the support; a drive support with a motor assembly configured for vibrating the assembly of the at least two screen decks; and a feed unit configured to feed the material to be screened to each screen deck; wherein the feed unit is arranged on the support and configured to be moved between a feed position and a maintenance position, and wherein the assembly of the at least two screen decks is resiliently arranged on the support, while the feed unit is non-resiliently arranged on the support.

By arranging the feed unit on the support and being configured to be moved between a feed position and a maintenance position, easy access to the assembly of the at least two screen decks, as well as the feed unit is enabled when the feed unit is set in the maintenance position. By arranging the feed unit on the support non-resiliently, while the assembly of the at least two screen decks is resiliently arranged on the support, the feed unit will be still, while the assembly of the at least two screen decks will vibrate during operation.

In one embodiment of the invention, the feed unit is articulately arranged on the support, and in one embodiment the feed unit is articulately arranged on a lower part of the support.

In one embodiment, the vibratory screening apparatus further comprises an abutment support attached to the support and arranged to provide an abutment surface for the feed unit when set in the feed position. Thus, in this embodiment the feed unit is not locked to the different screen decks, but are aligned to the assembly of the at least two screen decks to distribute material to each screen deck. This enables, among others, easy movement of the feed unit between the feed position and the maintenance position.

In a further embodiment, the at least two screen decks are arranged directly piled on top of each other. The assembly of the at least two screen decks may even be self-supporting.

In one embodiment the screen decks have notches and protrusions which are configured to interact with corresponding notches and protrusions on the adjacent screen decks in the assembly when being piled directly on top of each other.

In one embodiment the vibratory screening apparatus may further comprise a tension strut configured to maintain the assembly of the at least two screen decks tight together.

In yet another embodiment of the invention, the assembly of the at least two screen decks are configured to allow replacement as a single unit with a new assembly of at least two screen decks.

In one embodiment, the above disclosed mountings may be resilient mountings.

In one embodiment of the vibratory screening apparatus, the assembly of the at least two screen decks has a first side facing the support, which first side is fasten to the support with at least one resilient mounting.

In a further embodiment of the vibratory screening apparatus, the assembly has a second side, opposite the first side, which the second side is fastened to the drive support, and wherein the drive support is fastened to the support with at least one resilient mounting.

In one embodiment of the vibratory screening apparatus, the assembly of the at least two screen decks has a first side facing the support, wherein the assembly is fastened to the support with at least two mountings, while the second side of the assembly, opposite the first side, is fastened to the support with at least one mountings.

In one embodiment of the vibratory screening apparatus, the assembly of the at least two screen decks has a first side facing the support, which first side is fastened to the support with at least one mounting, while the second side of the assembly, opposite the first side, is fastened to the support with at least two mountings.

In one embodiment of the vibratory screening apparatus, the support comprises a lower part of the support and an inclined part of the support. In such an embodiment, the first side facing the lower part of the support may be fastened to the lower part of the support with at least one mounting, while the second side of the assembly, opposite the first side, may be fastened to the inclined part of the support with at least one mounting.

Also in an embodiment of the vibratory screening apparatus, the support may comprise a lower part of the support and an inclined part of the support. In such an embodiment, the first side facing the lower part of the support may be fastened to the lower part of the support with at least one resilient mounting, while the second side of the assembly, opposite the first side, may be fastened to the drive support, and the drive support may be fastened to the inclined part of the support with at least one resilient mounting.

Other objectives, features and advantages of the present invention will appear from the following detailed disclosure, from the attached claims, as well as from the drawings. It is noted that the invention relates to all possible combination of features.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. The steps of any method disclosed herein do not have to be performed in the exact order disclosed, unless explicitly stated. As used herein, the term "comprising" and variations of that term are not intended to exclude other additives, components, integers or steps.

BRIEF DESCRIPTION OF THE DRAWINGS

The invention will be described in more detail with reference to the appended schematic drawings, which show examples of presently preferred embodiments of the invention.

DETAILED DESCRIPTION

Figure 1:
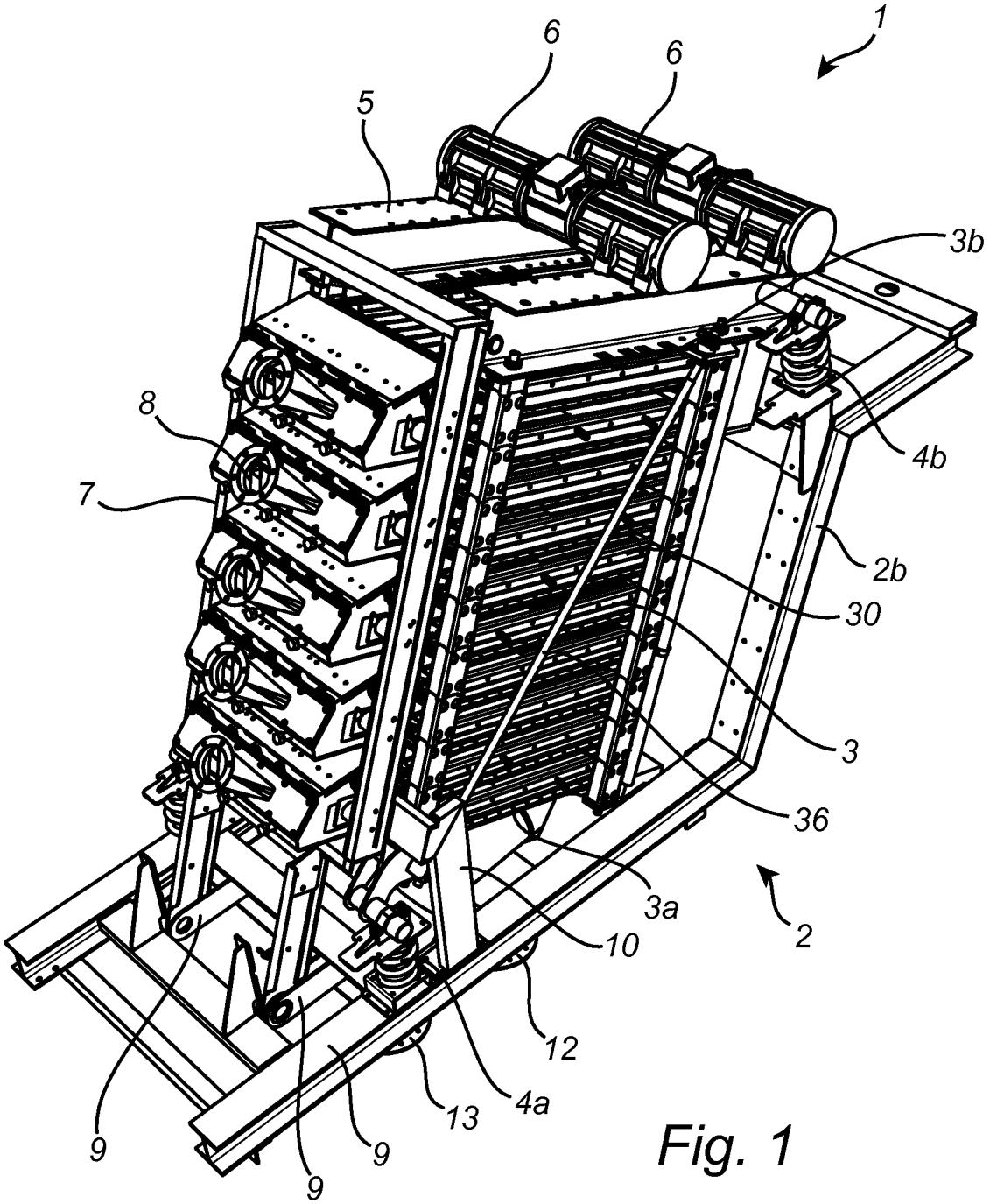
FIG. 1 is a perspective view of a vibratory screening apparatus according to one embodiment of the invention.

The present invention will now be described more fully hereinafter with reference to the accompanying drawings, in which currently preferred embodiments of the invention are shown. The present invention may, however, be embodied in many different forms and should not be construed as limited to the embodiments set forth herein; rather, these embodiments are provided for thoroughness and completeness, and to fully convey the scope of the invention to the skilled addressee. Like reference characters refer to like elements throughout.

Figure 2:
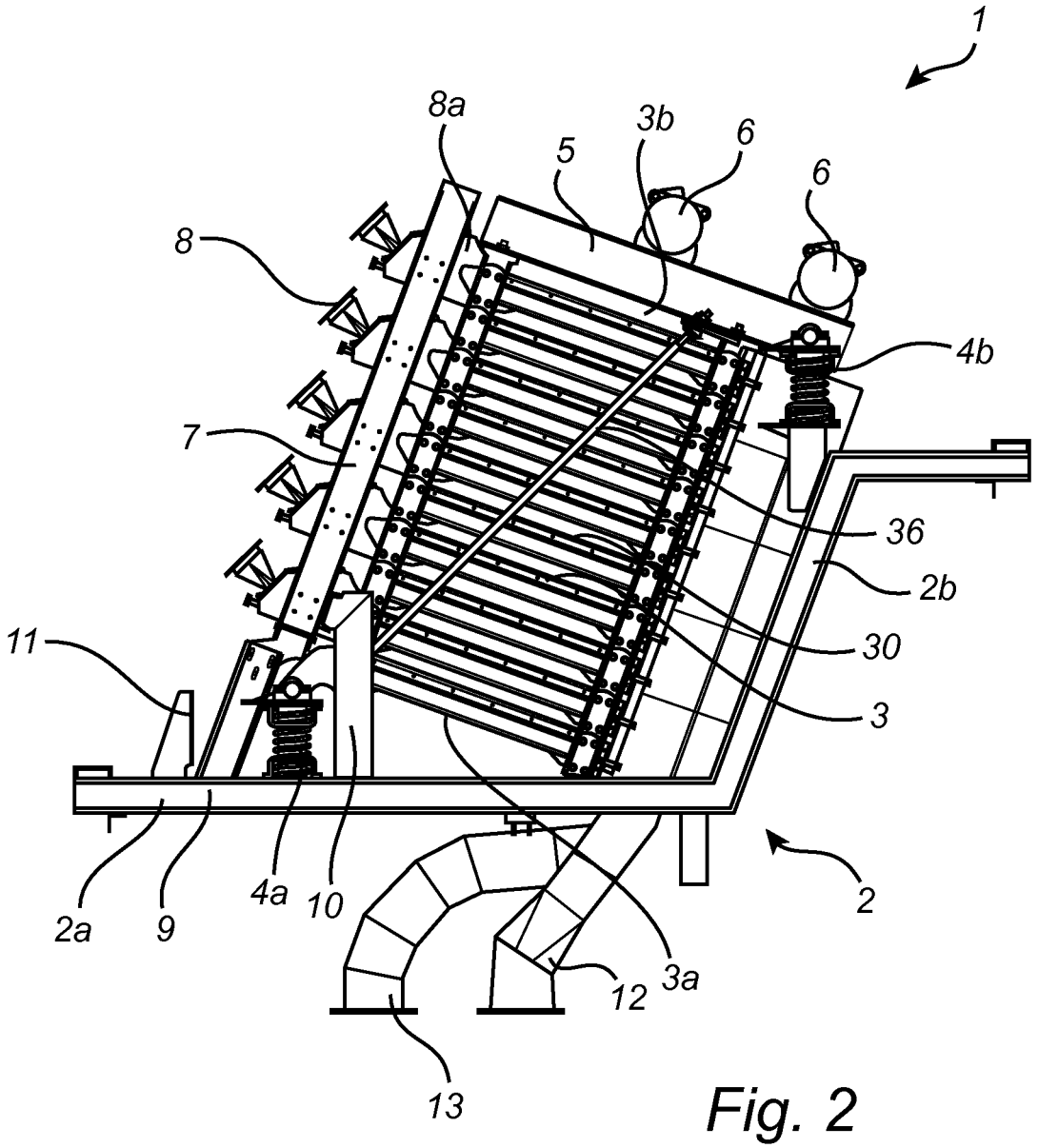
FIG. 2 is a side view of the vibratory screening apparatus of FIG. 1 with the feed unit in a feeding position.
Figure 3:
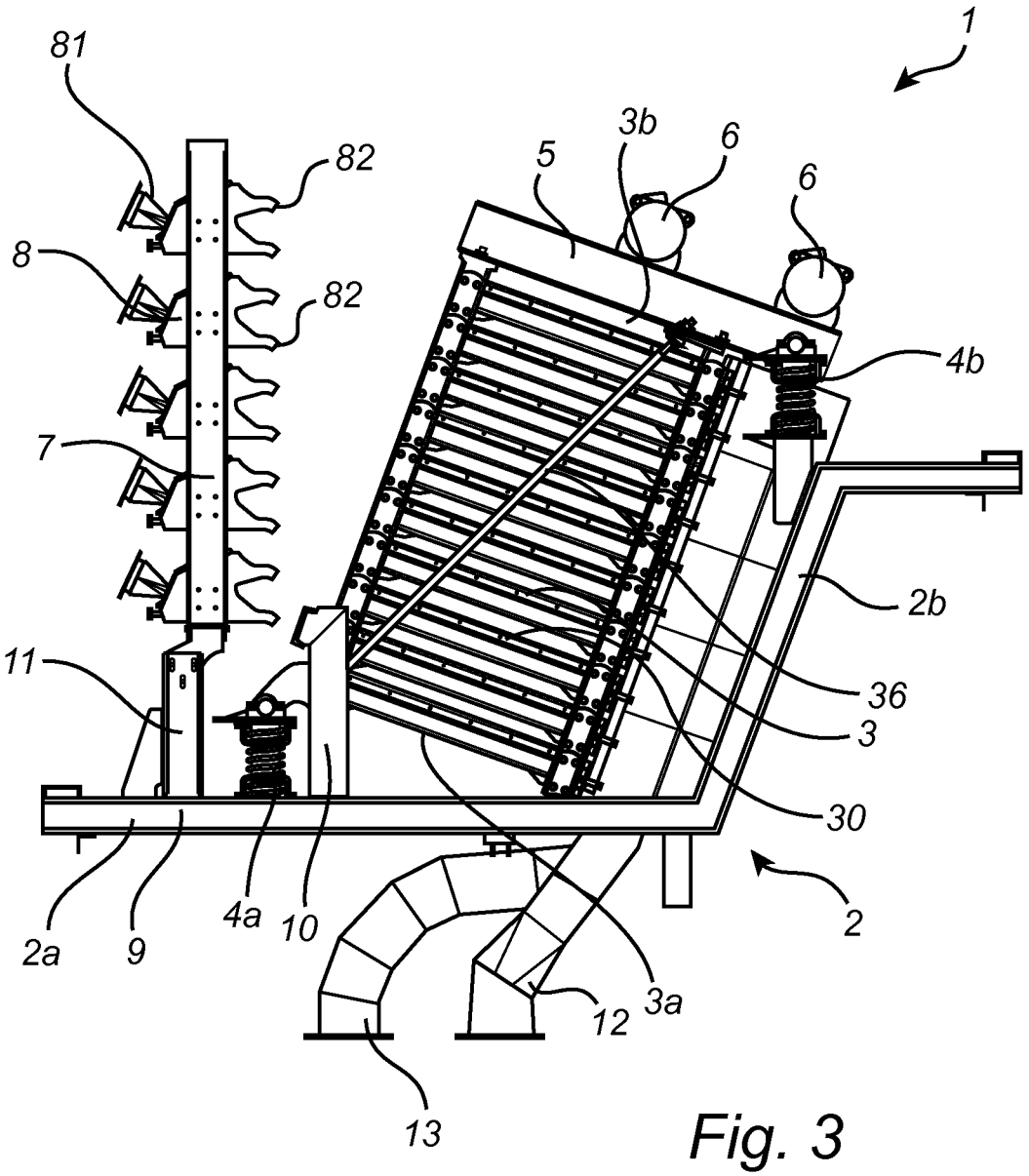
FIG. 3 is a side view of the vibratory screening apparatus of FIG. 1 with the feed unit in a maintenance position.

FIGS. 1, 2 and 3 show a vibratory screening apparatus 1 according to one embodiment of the invention. The vibratory screening apparatus 1 has a support 2 including a lower part 2*a* and an inclined part 2*b*. Screen decks 30 are piled directly on top of each other forming an assembly 3 of the screen decks 30. The assembly 3 of screen decks 30 has a first side 3*a* facing the lower part 2*a* of the support 2, which first side 3*a* is attached with the lower part 2*a* of the support 2 with two resilient mountings 4*a*. On a second side 3*b*, opposite the first side 3*a*, the assembly 3 of screen decks 30 is attached to a drive support 5 with a motor assembly 6. The drive support 5 is attached to the inclined part 2*b* of the support 2 with two resilient mountings 4*b*.

A feed unit 7 with a number of distributors 8 is arranged on the support 2 with an articulated coupling 9 to be movable between a feed position as shown in FIGS. 1 and 2, and a maintenance position as shown in FIG. 3.

The vibratory screening apparatus 1 further has an abutment support 10 attached to the lower part 2*a* of the support 2, and this abutment support 10 is arranged to provide an abutment surface for the feed unit 7 when set in the feed position. Thus, the feed unit 7 does not rest upon the assembly 3 of screen decks 30, but only align the different distributors 8 with the screen decks 30.

The distributor outlets 8*a* may in one embodiment comprise a flexible material to bridge any distance between the distributor outlet 8*a* and the screen decks 30.

The vibratory screening apparatus 1 may further comprise a second abutment support 11, also this attached to the lower part 2*a* of the support 2, and this second abutment support 11 is arranged to provide an abutment surface for the feed unit 7 when set in the maintenance position as shown in FIG. 3.

Figure 4:
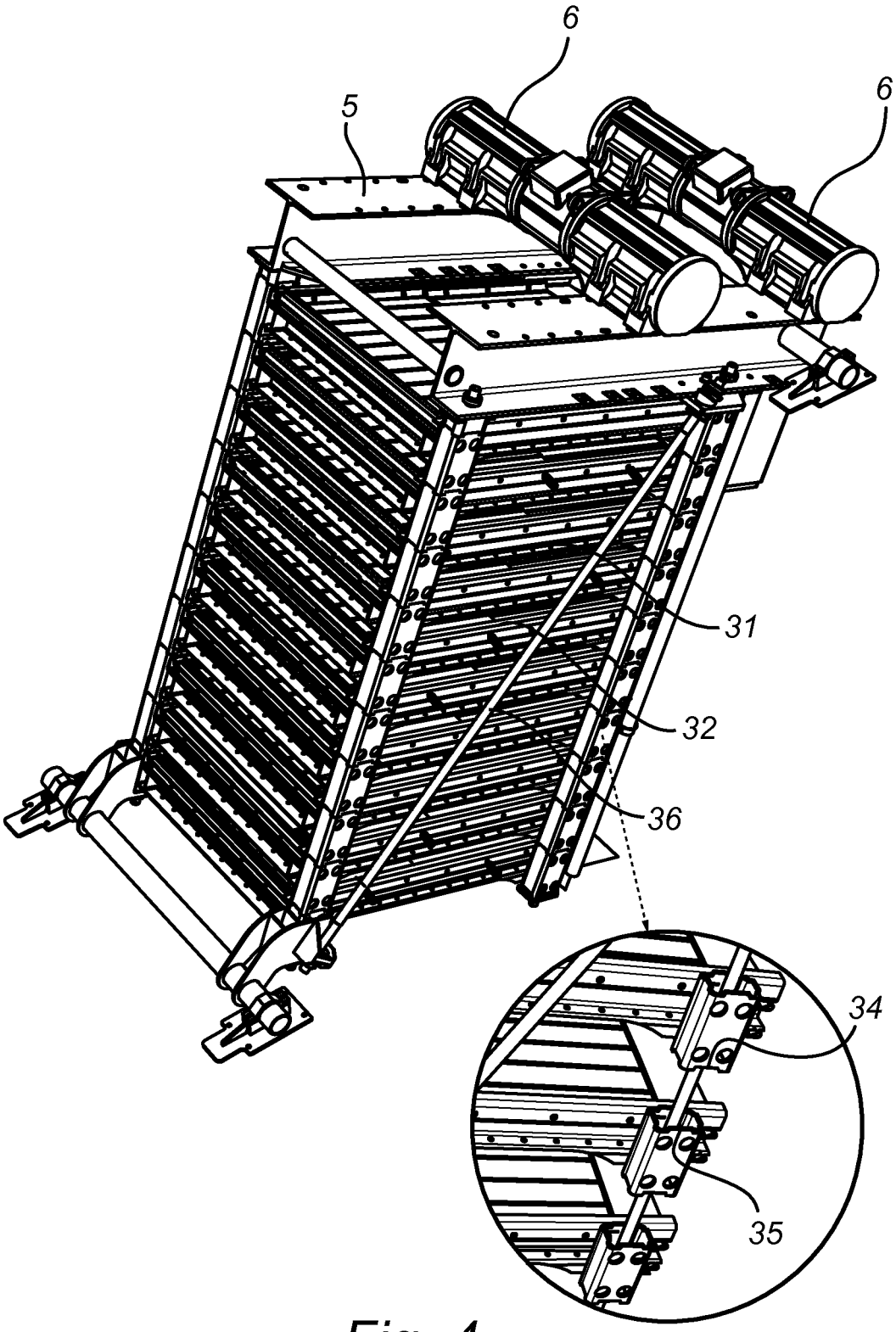
FIG. 4 is a perspective view of a screen deck assembly with a drive support including a motor assembly according to one embodiment of the invention, further showing a close up and an exploded view of a part of the screen frame.

In FIG. 4 a perspective view of the assembly 3 of the screen decks 30 together with the drive support 5 and the motor assembly 6 is shown. Each screen deck 30 comprises a screen frame 31, a screen 32 and a chamber underlaying the screen surface. The chamber is however not evident from FIG. 4.

As shown in FIGS. 1, 2 and 3, the vibratory screening apparatus 1 has an outlet duct 12 for oversized material and an outlet duct 13 for undersized material. The outlet duct 12 for oversized material is in communication with the upper surface of the screen decks 30, and the outlet duct 13 for undersized material is in communication with the chambers.

The screen decks 30 may be piled directly on top of each other by piling the screen frames 31 on top of each other. In the shown embodiment, and as also evident from the close up shown in FIG. 4, the aligning of the screen frame 31 is made with the aid of notches 34 and protrusions 35 arranged on the screen frames 31, which notches 34 and protrusions 35 are configured to interact with corresponding notches 34 and protrusion 35 on the adjacent screen decks 30 in the assembly 3.

The screen decks 30 are held together by a tension strut 36, and the screen deck assembly 3 as such is self-supporting with the piled screen frames 31.

Figure 5:
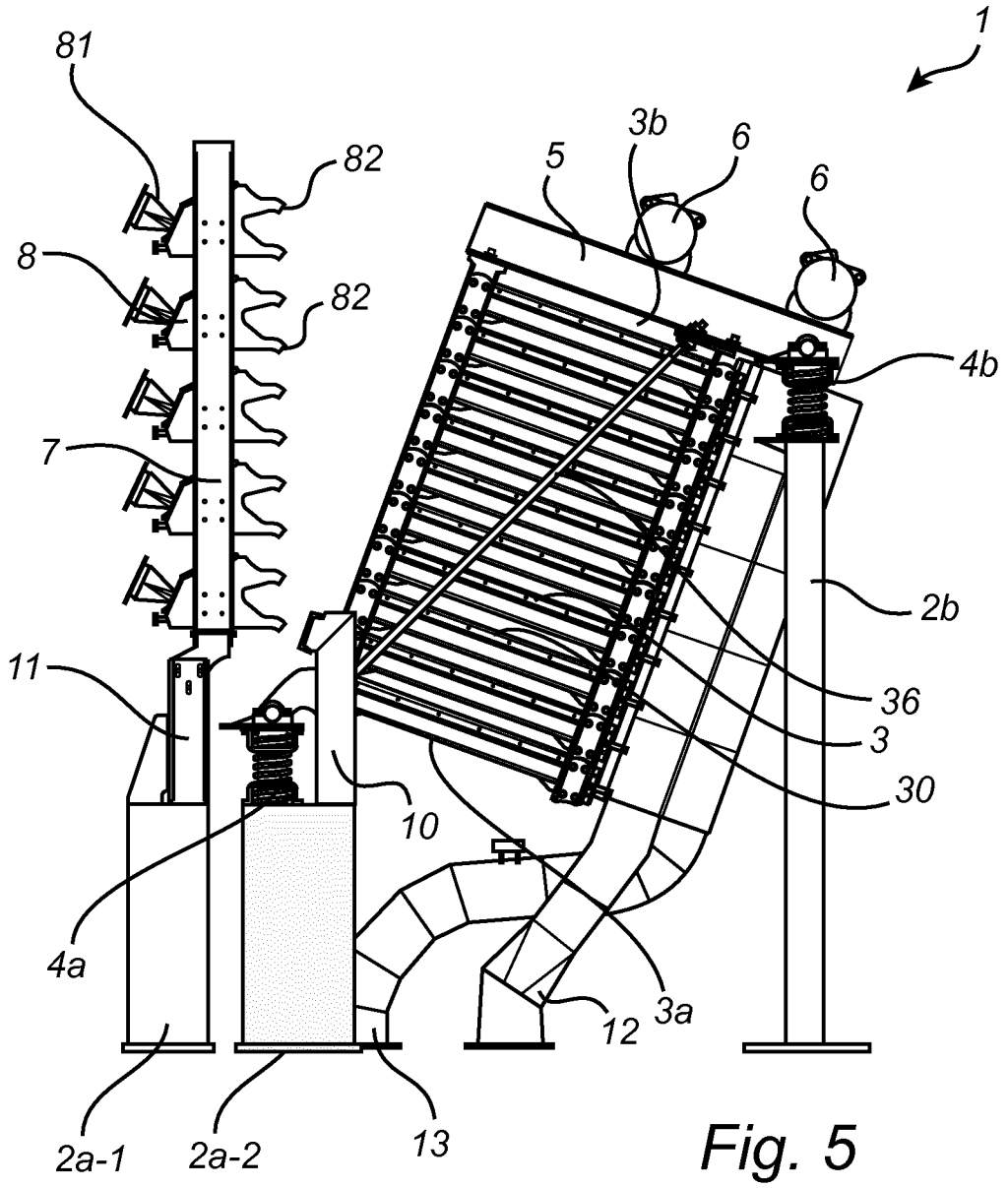
FIG. 5 is a side view of a vibratory screening apparatus according to another embodiment of the invention.

When maintenance is to be made on the assembly 3 of screen decks 30 or on the feed unit 7, the feed unit 7 is moved to its maintenance position, as shown in FIG. 3 and FIG. 5. In this position, the feed unit 7 may be maintained and/or the assembly 3 of screen decks 30 may be maintained. In one embodiment the whole assembly 3 of screen decks 30 may be replaced as one single unit. The assembly 3 is loosened from the resilient mountings 4*a* on the first side 3*a*, the drive support 5 is loosened from the resilient mountings 4*b* on the inclined part 2*b* of the support 2, and the drive support 5 is loosened from the second side 3*b* of the assembly 3. The assembly 3 is removed and replaced with a new assembly 3 of screen decks 30.

In FIG. 5 another embodiment of the invention is shown, a vibratory screening apparatus 1 that has an alternative support 2 to the one shown in FIGS. 1-3. In this embodiment a separate support member 2*a*-1 may be arranged for mounting of the first side 3*a* of the assembly 3 and the abutment support 10, and another separate support member 2*a*-2 may be arranged for the articulated coupling 9. A further separate support member 2*b* is arranged for mounting of the second side 3*b* of the assembly 3, either directly, or in case of a vibratory screening apparatus 1, via a drive support 5.

The skilled person realizes that a number of modifications of the embodiments described herein are possible without departing from the scope of the invention, which is defined in the appended claims.

For instance, the screen decks do not necessarily have to be piled directly on top of each other, they may also be attached to a support arrangement supporting each screen deck separately, but the screen decks may still be arranged as an assembly.

The invention claimed is:

1. A vibratory screening apparatus comprising:

a support;

at least two screen decks arranged one over the other as an assembly, each screen deck including a screen frame, a screen and a chamber underlaying the screen surface, an outlet duct for oversized material and an outlet duct for undersized material that is in communication with the chamber;

mountings configured for mounting the assembly of the at least two screen decks to the support;

a drive support with a motor assembly configured for vibrating the assembly of the at least two screen decks; and a feed unit configured to feed the material to be screened to each screen deck;

wherein the feed unit is arranged on the support and configured to be moved between a feed position and a maintenance position, wherein the feed unit is non-resiliently arranged on the support; and in that the assembly of the at least two screen decks is resiliently arranged on the support, wherein the assembly of screen decks has a first side facing the support, which first side is fastened to the support with at least one resilient mounting, and wherein the assembly has a second side, opposite the first side, which second side is fastened to the drive support, and wherein the drive support is fastened to the support with at least one resilient mounting.

2. The vibratory screening apparatus according to claim 1, wherein the feed unit is articulately arranged on the support.

3. The vibratory screening apparatus according to claim 1, further comprising an abutment support attached to the support and arranged to provide an abutment surface for the feed unit when set in the feed position.

4. The vibratory screening apparatus according to claim 1, wherein the at least two screen decks are arranged directly piled on top of each other.

5. The vibratory screening apparatus according to claim 4, wherein the assembly of screen decks is self-supporting.

6. The vibratory screening apparatus according to claim 4, wherein the screen decks have notches and protrusions which are configured to interact with corresponding notches and protrusions on the adjacent screen decks in the assembly.

7. The vibratory screening apparatus according to claim 4, further comprising a tension strut configured to maintain the assembly of the at least two screen decks together.

8. The vibratory screening apparatus according to claim 1, wherein the assembly of the at least two screen decks are configured to allow replacement as a single unit with a new assembly of at least two screen decks.

9. The vibratory screening apparatus according to claim 1, wherein the mountings are resilient mountings.

10. The vibratory screening apparatus according to claim 1, wherein the support comprises a lower part of the support and an inclined part of the support.

11. The vibratory screening apparatus according to claim 10, wherein the assembly of screen decks has a first side facing the lower part of the support, which first side is fastened to the lower part of the support with at least one mounting; and wherein the assembly has a second side, opposite the first side, wherein the second side is fastened directly or indirectly to the inclined part of the support.

* * * * *